United States Patent [19]

Kirch et al.

[11] Patent Number: 4,681,051

[45] Date of Patent: Jul. 21, 1987

[54] GUIDE DEVICE FOR THE WORKPIECE OF A SEWING MACHINE

[75] Inventors: Otto Kirch, Mehlingen; Erich Willenbacher, Kaiserslautern, both of Fed. Rep. of Germany

[73] Assignee: Pfaff Industriemaschinen GmbH, Fed. Rep. of Germany

[21] Appl. No.: 870,248

[22] Filed: Jun. 2, 1986

[30] Foreign Application Priority Data

Jun. 3, 1985 [DE] Fed. Rep. of Germany ... 8516184[U]

[51] Int. Cl.[4] ..... D05B 27/10

[52] U.S. Cl. ..... 112/306; 112/322; 112/DIG. 3

[58] Field of Search ..... 112/306, 322, 318, 312, 112/DIG. 3; 226/186–188

[56] References Cited

U.S. PATENT DOCUMENTS

| | | | |
|---|---|---|---|
| 4,292,908 | 10/1981 | Blessing | 112/312 X |
| 4,462,530 | 7/1984 | Block et al. | 112/322 X |
| 4,466,367 | 8/1984 | Price et al. | 112/322 X |
| 4,526,119 | 7/1985 | von Hagen | 112/322 |
| 4,572,094 | 2/1986 | Taddicken | 112/322 |

*Primary Examiner*—Werner H. Schroeder
*Assistant Examiner*—Andrew M. Falik
*Attorney, Agent, or Firm*—McGlew and Tuttle

[57] ABSTRACT

A guide device for the workpieces on a sewing machine comprises driven guide wheels arranged one above and one below the workpiece, and revolving in a plane extending crosswise to a sewing direction for the workpieces. The guide wheels are each mounted on a low-mass rocker which are, in turn, mounted on a support. Due to the low-mass construction of the rockers, they form together with the respective guide wheels, vibratory systems uncoupled from the respective supports, whereby a uniform frictional contact between the guide wheels and the workpieces is achieved.

8 Claims, 1 Drawing Figure

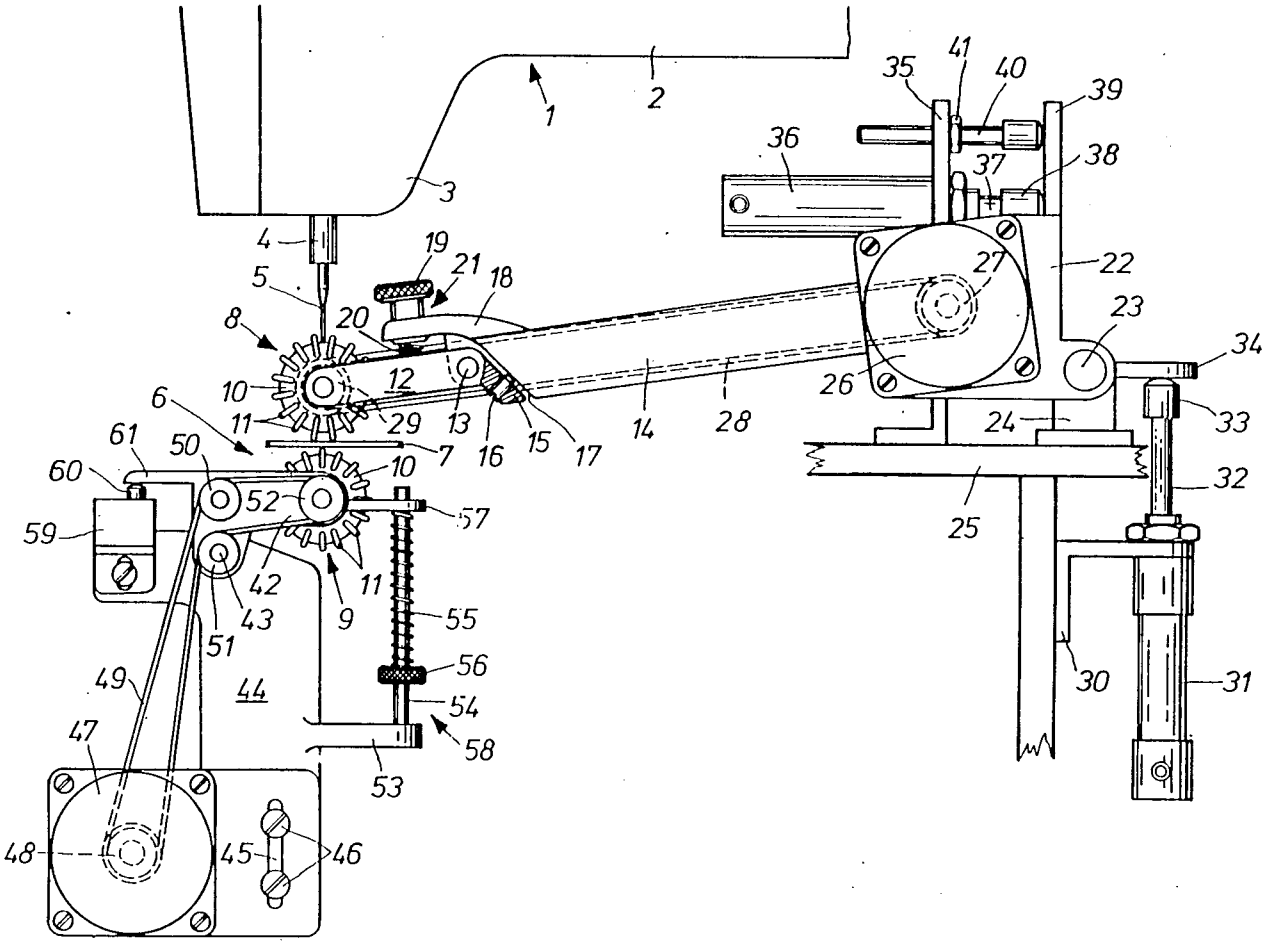
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
57
58
59
60
61

GUIDE DEVICE FOR THE WORKPIECE OF A SEWING MACHINE

FIELD AND BACKGROUND OF THE INVENTION

The present invention relates in general to sewing machines and in particular to a new and useful guide device for guiding workpieces to be sewn by a sewing machine, the guide device including at least one guide wheel which is rotatably mounted on a rocker for movement into and out of engagement with the workpiece.

A guide device having a guide wheel is disclosed in U.S. Pat. No. 4,292,908. For guiding work consisting of two plies of cloth, this guide device has an upper and a lower guide wheel. Both guide wheels carry on the circumference of the wheel bodies, a plurality of freely rotatable rollers arranged crosswise to the wheel plane. The guide wheels are mounted on a support in the form of a pivotable arm, on which also a belt drive is arranged which connects the guide wheel to a motor attached to the support.

Since, due to the mutual distance of the rollers, the guide wheels have an out-of-round polygon-like circumference, the supports are alternately slightly lowered and raised as the guide wheels roll on and off the work. Superimposed on these movements may be vibrations caused by the sewing machine, so that at certain sewing and control speeds the supports execute uncontrolled swinging motions which impair the aligning action of the guide device.

SUMMARY OF THE INVENTION

It is an object of the present innovation to provide a guide device which is largely insensitive to vibrations, whether they are produced by the device itself or caused externally.

By mounting the guide wheel on a low-mass spring-loaded rocker and arranging the support so that it is immobile at least when the guide wheel is in an operating position, the guide wheel and rocker form a vibratory system uncoupled from the support and from the motor for the guide wheel. In this way the guide wheel maintains a uniform frictional contact with the work even at high speeds of rotation. The force exerted by the spring mechanism on the rocker and hence the pressing force of the guide wheel on the work may then be relatively small, so that the advance of the work is not hindered. By uncoupling the guide wheel from the support in terms of vibration, vibrations acting on the support that are produced by the sewing machine are not transmitted to the rocker or to the guide wheel, or are transmitted only in small part.

Another object of the invention is to provide a guide device as defined above, wherein the guide wheel is arranged above the work, and characterized in that the support is formed by a pivotable arm associated with a stop which establishes its operating position, and a pneumatic cylinder pressing the arm against the stop. A pneumatic cylinder may also be provided for lifting the arm.

In this way the support for a guide wheel disposed above the work plane is designed as a swivel arm which, by means of a pneumatic cylinder, is moved against a stop, determining its operating position and is retained in this position.

In cooperation with an abutment on the arm, the stop on the rocker limits the lower swivel position of the rocker.

With the aid of the further cylinder the guide wheel can be raised to a far extent, so that sufficient space can be created for manipulation and visual control when, inserting a new workpiece.

A further object of the present invention is to provide a guide device when the guide wheel is arranged below the work, the support being fixed to a rocker which has a pneumatic piston associated therewith for lowering the rocker, the pneumatic cylinder having a piston rod which forms, at the same time, a stop for establishing the operating position of the guide wheel.

Because, when inserting a new workpiece, a guide wheel arranged below the work plane need not be lowered as far as an upper guide wheel should be raisable, the support may in this case be arranged fixed, with the piston rod of the pneumatic cylinder used for lowering serving, at the same time,as a stop which determines the operating position of the guide wheel.

A still further object of the invention is to provide a guide device for a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawing and descriptive matter in which a preferred embodiment of the invention is illustrated.

BRIEF DESCRIPTION OF THE DRAWING

The only FIGURE of the drawing is a partial, side elevational view of the inventive guide device.

DESCRIPTION OF THE PREFERRED EMBODIMENT

In the FIGURE, part of a sewing machine 1 is shown including an arm 2 and a head 3 of the sewing machine housing. In head 3, a needle bar 4, driven in known manner, is arranged, which carries a thread-holding needle 5.

For edge-correct guiding of two plies of cloth (not shown) that are separated by an intermediate metal sheet 7, a guide device 6 comprises an upper guide wheel 8 and a lower guide wheel 9. Both guide wheels 8,9 carry on the circumferences of their wheel bodies 10, a plurality of freely rotating rollers 11 arranged to rotate crosswise to the wheel plane. The outer edge of each roller 11 is visible in the drawing.

The upper guide wheel 8 is mounted on a short, low-mass rocker 12 which is articulated to one end of an arm 14 by a bolt 13. The rocker 12 is braced by an adjustable screw 16 disposed in a shoulder 15 against an abutment surface 17 of arm 14. A set screw 19 is received in a projection 18 of arm 14. A compression spring 20 is arranged in the hollow shank of set screw 19, which presses onto the top side of rocker 12. The structural elements 18 to 20 form a spring mechanism 21.

At its other end, arm 14 (which is longer and heavier than rocker 12) is fastened to a plate 22 which, by a bolt 23, is pivotally mounted on a bearing block 24. The bearing block 24 is secured on a partially shown table frame 25 (forming a fixed frame). On plate 22 a step motor 26 is arranged, which drives a toothed belt 28 via a pulley 27. The toothed belt 28 is in driving connection with a pulley 29 formed at the wheel body 10 of the upper guide wheel 8.

A pneumatic cylinder is arranged on a bracket 30 fastened on the table frame 25. A ram 33 secured on the piston rod 32 of cylinder 31 cooperates with a projection 34 formed on plate 22. On another bracket 35 fastened on the table frame 25, a pneumatic cylinder 36 is arranged. A ram 38 secured on piston rod 37 of cylinder 36 cooperates with a projection 39 formed on plate 22. A threaded pin 40 is furthermore disposed on bracket 38, the position of which can be secured by a lock nut 41. The threaded pin 40 cooperates with the projection 39.

The lower guide wheel 9 is mounted on a short, L-shaped, low-mass rocker 42. By a bolt 43 the rocker 42 is arranged to swivel at a support 44 which, by means of a slot 45 and two screws 46, is adjustably attached to the table frame 25. On support 44 a step motor 47 is arranged which, via a pulley 48, drives a toothed belt 49. Belt 49 runs over a guide wheel 50 mounted on rocker 42 and another guide wheel 51 disposed on bolt 43 and is in driving connection with a pulley 52 formed at the wheel body 10 of the lower guide wheel 9.

A threaded pin is fastened on a projection 53 of support 44. A compression spring 55 is cottered on the threaded pin 54, which is braced at one end against an adjusting nut 56 and at the other end against a projection 57 formed on rocker 42. Projection 57 has a cutout (not shown) for passage of the threaded pin 54. The structural elements 53 to 57 form a spring mechanism 58.

An adjustable pneumatic cylinder 59 is secured on support 44. The piston rod 60 of cylinder 59 cooperates with a projection 61 formed on rocker 42.

In the operating position of the upper guide wheel 8 the piston rod 37 of pneumatic cylinder 36 is retracted and the piston rod 32 of pneumatic cylinder 31 is extended, owing to which the arm 14 is braced against the threaded pin 40 via the projection 39. The position of the threaded pin 40 serving as stop determines the lower position of the upper guide wheel 8. The screw 16 determining the lower swivel position of rocker 12 is adjusted so that guide wheel 8 just barely touches the exposed intermediate plate 7. If a ply of cloth lies on the intermediate plate 7, rocker 12 is rotated clockwise by a small angle counter to the force of the compression spring 20. In this manner the guide wheel 8 and the rocker 12 can move relative to arm 14 when vibrations or oscillations occur.

In the operating position of the lower guide wheel 9, the piston rod 60 of pneumatic cylinder 59 is retracted. The vertical position of pneumatic cylinder 59 is chosen so that with the intermediate plate 7 exposed, the compression spring 55 presses the projection 61 of rocker 42 against the piston rod 60 and that then the guide wheel 9 barely touches the intermediate plate 7. If a ply of cloth lies under the intermediate plate 7, rocker 42 is rotated clockwise by a small angle counter to the force of compression spring 55. In this manner the guide wheel 9 and the rocker 42 can move relative to support 44 when vibrations or oscillations occur.

For the insertion of two plies of cloth on or respectively under the intermediate plate 7, the piston rod 32 of pneumatic cylinder 31 is retracted and the piston rods 37 and 60 of the pneumatic cylinders 36 and 59, respectively, are extended and thereby arm 14 with rocker 12 as well as rocker 42 is rotated clockwise, whereby the guide wheels 8 and 9 move away from the intermediate plate 7.

While a specific embodiment of the invention has been shown and described in detail to illustrate the application of the principles of the invention, it will be understood that the invention may be embodied otherwise without departing from such principles.

What is claimed is:

1. A guide device for sewing work moving in a sewing direction on a sewing machine having an arm extending in a longitudinal direction which is crosswise to the sewing direction, comprising at least one driven guide wheel rotating in a plane extending crosswise to the sewing direction and parallel to the longitudinal direction said wheel being moveable between an operating position in engagement with a sewing work and an inactive position spaced from the sewing work, and a support which is fixed at least when said guide wheel is in said operating position, a low-mass rocker for rotatably carrying said guide wheel, said rocker being movably connected to said support for movement between said operating and inactive positions, and spring means engaged between said support and said rocker for urging said rocker to move said guide wheel toward said operating position.

2. A guide device according to claim 1 wherein said rocker is shorter than said support.

3. A guide device for sewing work moving in a sewing direction on a sewing machine, comprising at least one driven guide wheel rotating in a plane extending crosswise to the sewing direction said wheel being moveable between an operating position in engagement with a sewing work and an inactive position spaced from the sewing work, and a support which is fixed at least when said guide wheel is in said operating position, a low-mass rocker for rotatably carrying said guide wheel, said rocker being movably connected to said support for movement between said operating and inactive positions, and spring means engaged between said support and said rocker for urging said rocker to move said guide wheel towards said operating position, said guide wheel being mounted for engagement over the sewing work, a fixed frame, said support comprising an arm pivotally mounted to said fixed frame, a stop engaged between said arm and said fixed frame for establishing an operating position of said arm for bringing said guide wheel into its operating position, and a pneumatic cylinder and piston combination connected between said arm and said fixed frame for urging said arm against said stop.

4. A guide device according to claim 3 wherein said rocker includes a further stop and said arm includes an abutment against which said further stop is engaged, said further stop being engaged against said abutment by the force of said spring means for holding said rocker in its operating position.

5. A guide device according to claim 3 including a further pneumatic cylinder and piston combination connected between said arm and said fixed frame for lifting said arm away from engagement with said stop and for thus moving said arm and said guide wheel out of their operating positions.

6. A guide device according to claim 3 wherein said rocker is shorter than said support.

7. A guide device for sewing work moving in a sewing direction on a sewing machine, comprising at least one driven guide wheel rotating in a plane extending crosswise to the sewing direction, said wheel being moveable between an operating position in engagement with a sewing work and inactive position spaced from the sewing work, and a support which is fixed at least when said guide wheel is in said operating position, a low-mass rocker for rotatably carrying said guide wheel, said rocker being movably connected to said support for movement between said operating and inactive positions, and spring means engaged between said support and said rocker for urging said rocker to move said guide wheel towards said operating position, said guide wheel being mounted for engagement below a sewing work, said support being fixed in all positions of said rocker, a pneumatic cylinder and piston combination connected between said rocker and said support for acting as a stop for establishing said operating position of said guide wheel, and activatable to move said rocker against said spring means to bring said guide wheel into its inactive position.

8. A guide device according to claim 7 wherein said rocker is shorter than said support.

* * * * *